United States Patent [19]

Hays

[11] 3,934,623

[45] Jan. 27, 1976

[54] VALVE COVER HAVING OIL CAN OPENER

[76] Inventor: Wilford R. Hays, 2218 Princeton Ave., Los Angeles, Calif. 90026

[22] Filed: Oct. 30, 1974

[21] Appl. No.: 519,089

[52] U.S. Cl. ..... 141/98; 141/364; 141/330

[51] Int. Cl.[2] ..... B65B 3/04

[58] Field of Search ..... 141/329, 330, 363, 364, 141/98; 184/105 R; 222/81, 83.5, 86, 88

[56] References Cited

UNITED STATES PATENTS

| | | | |
|---|---|---|---|
| 2,130,085 | 9/1938 | Harks | 184/105 |
| 2,134,004 | 10/1938 | Pittman | 184/105 |
| 2,644,430 | 7/1953 | Lang | 222/83.5 |
| 3,115,908 | 12/1963 | Carlson et al. | 141/330 |
| 3,331,405 | 7/1967 | Guadet | 141/330 |
| 3,774,722 | 11/1973 | Elder | 141/330 |

*Primary Examiner*—Houston S. Bell, Jr.
*Attorney, Agent, or Firm*—Harvey S. Hertz

[57] ABSTRACT

A valve cover for an engine contains a built-in oil can opener. The valve cover is shaped as an elongated trough member defined by a top wall and a side wall. The free edges of the side wall are integrally connected to a mounting flange for securing the valve cover to a mounting block. A cylindrically shaped cavity whose axis intersects the plane of the mounting flange, extends through the valve cover. A device for opening and draining oil cans is positioned in the cavity. A removable cap is positioned over the cavity adjacent to the valve cover top wall for closing the cavity.

7 Claims, 9 Drawing Figures

VALVE COVER HAVING OIL CAN OPENER

BACKGROUND OF THE INVENTION

1. Field of the Invention

The field of art to which the invention pertains includes the field of oil can openers, particularly with respect to an oil can opener which is integrally formed with a valve cover of an engine.

2. Description of the Prior Art

Conventional techniques for adding oil to an engine include the removal of an engine cap or cover and insertion of the oil can contents through an oil can opener. Such techniques result in leakage of the oil from the can due to an ineffective seal between the oil can and the oil can opener. While it has been suggested that oil can openers be built into the engine, these designs normally consist of an extending rod or other member which pierces the can as the oil drains into the engine. In present day automobile designs, it is necessary to minimize protruding and extending members due to the large amounts of equipment which must be positioned beneath the hood of the automobile.

Known prior art includes U.S. Pat. Nos. 2,644,430; 2,693,249; 2,744,656; 3,331,405; 3,744,722; 1,488,377; 1,924,704; 957,829; 1,411,542; 2,484,985; and 3,115,908.

The present invention provides an oil can opener which is built into a cavity of a valve cover. The oil can opener and the cavity take up a minimum of additional space in the valve cover. When a cavity cover is removed, the oil can is easily inserted into the cavity and oil automatically drains from the can. The oil can is then removed and the cover replaced. No spillage occurs during the process. The valve cover is aesthetically pleasing with the addition of the oil can cavity and cover.

SUMMARY OF THE INVENTION

A valve cover contains a built-in can opener. The valve cover is formed of an elongated trough having a top wall and a side wall, the free edges of the side wall being integrally connected to a mounting flange for securing the valve cover to a motor block. A cylindrically shaped cavity whose axis intersects the plane of the mounting flange extends through the valve cover. An opening mechanism is positioned in the cavity so that when an oil can is inserted in the cavity, the oil is drained into the engine. A removable cap is positioned over the cavity adjacent to the valve cover top wall for covering the cavity when the oil can opener is not in use.

The advantages of this invention, both as to its construction and mode of operation, will be readily appreciated as the same becomes better understood by reference to the following detailed description when considered in connection with the accompanying drawings in which like reference numerals designate like parts throughout the Figures.

DESCRIPTION OF THE PREFERRED EMBODIMENTS

Figure 1:
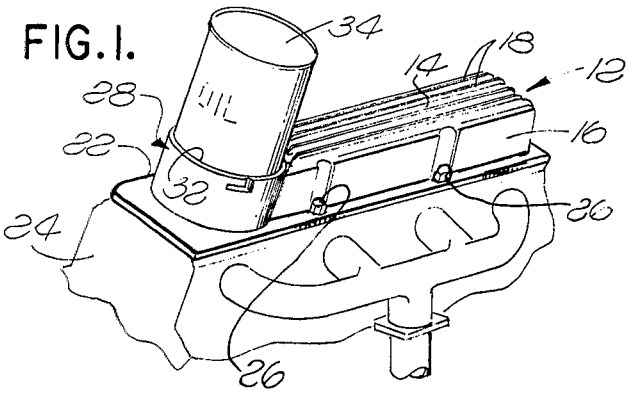
FIG. 1 is a perspective view, illustrating the insertion of an oil can into the valve cover of the invention.

Referring now to the drawings there is shown in FIG. 1, a valve cover 12 of an inverted trough shape configuration, constructed in accordance with principals of the invention. The valve cover includes a top wall 14 and side walls 16, with cooling fins 18 formed on the exterior surface of the top walls. The free bottom end of the side walls 16 is integrally formed with a mounting flange 22 formed in a plane generally parallel to the top wall 14. The mounting flange is used to secure the valve cover to an engine block 24. Typically a pair of bolts 26 are positioned on opposite sides of the valve cover (two of which are seen in FIG. 1). However, it should be understood that any number of bolts could be used to secure the valve cover to the engine block.

A cylindrical cavity 28 is integrally formed at one end of the valve cover. The cavity 28 contains an opening 32 of sufficient diameter such that an oil can 34 can be inserted therein with slight clearance between the side walls of the cavity.

Figure 2:
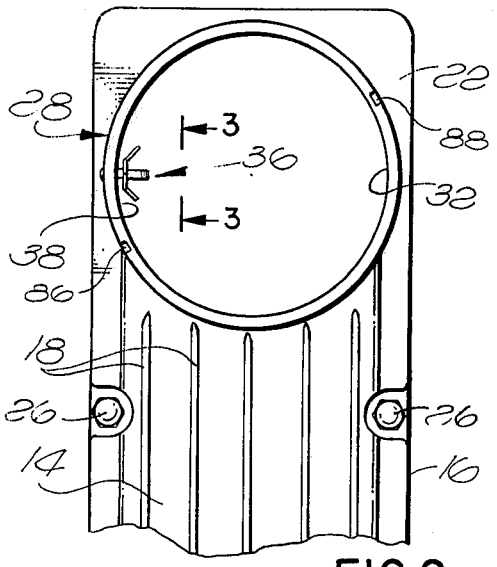
FIG. 2 is a partial top plan view of the valve cover of FIG. 1 with the cap removed.
Figure 3:
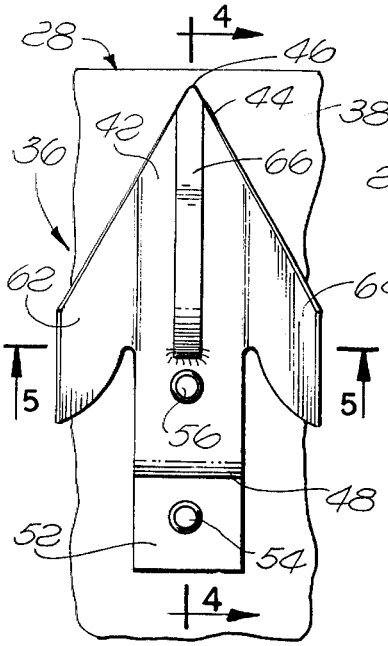
FIG. 3 is a front plan view of the oil can opening mechanism.
Figure 4:
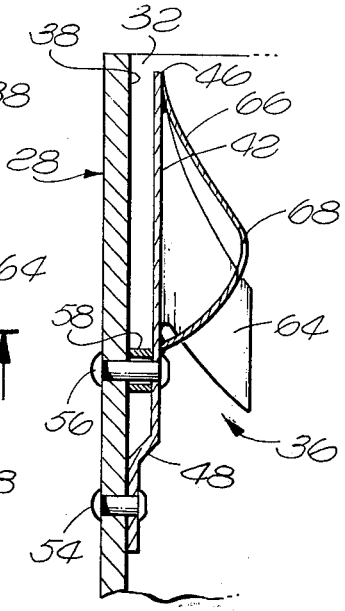
FIG. 4 is a side view, in cross-section, taken along the line 4—4 of FIG. 3 illustrating the technique for mounting the opener on the valve cover cavity.
Figure 5:
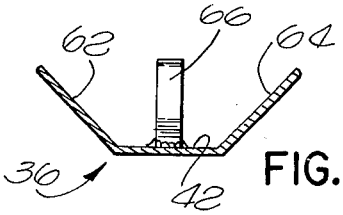
FIG. 5 is a cross-sectional view of the can opener taken along the line 5—5 of FIG. 3.
Figure 6:
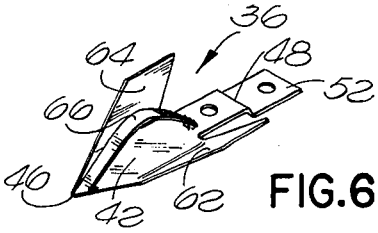
FIG. 6 is a perspective view of the oil can opener illustrating its novel structural features.

Referring now to FIG. 2 the cavity 28 is illustrated with the oil can 34 of FIG. 1 removed. A can opening mechanism 36 is positioned in the cavity and secured to the cavity side wall 38.

Referring now to FIGS. 3–6, the can opening mechanism 36 shown in greater detail. The mechanism 36 comprises a flat base member 42 which is positioned adjacent to and spaced from the cavity side wall 38. The top end of base 42 adjacent to the opening 32 in the cavity 28 contains a pointed cutting member 44 whose tip 46 is spaced slightly below the opening 32. The base 42 extends parallel to the axis of the cavity 28 from the tip 46 to an offset 48 which is integrally connected between the base 42 and a mounting arm 52. The mounting arm 52 is juxtaposed with the cavity side wall 38 and secured thereto by means of a first fastener 54. The first fastener 54 extends through the mounting arm 52 and the cavity side wall 38 so as to secure the cutting member 44 to the cavity. A second fastener 56 secures the base 42 to the cavity side wall 38 and the spacer sleeve 58 surrounds the second fastener 56 intermediate the cavity side wall 38 and the base 42 enabling the base to be spaced a desirable distance from the cavity side wall 38. In addition the spacer sleeve provides a stop for the oil can 34 when it is inserted into the cavity 28.

A pair of flanges 62 and 64 are positioned on opposite sides of the base 42 and flare out at an angle of 45 degrees from the base with the edges of the flanges forming a continuation of the pointed cutting member 44. Typically, the flange angle is chosen to be spread a sufficient distance around an engine valve keeper (not shown) so as to form a sufficient clearance with the valve keeper.

A track 66 formed of a thin strip of steel extends from the cutting member tip 46 to the base 42 and is secured to the base directly above the second fastener 56. The track is initially adjacent to the cutting member tip 46 and then flares outwardly between the flanges 62 and 64 prior to being secured at one end adjacent to the second fastener 56. Typically, the track is butt welded at the tip 46 and the base 42. The track is spaced from the base 42 such that at the tip portion 46, the oil can will initially be cut by the tip edges and then the track will abut the end of the can which is being cut open. Subsequently, at its flared portion 68 adjacent to flanges 62 and 64, the track initially abuts the can end prior to a transverse plane portion of the flanges 62 and 64 cutting into the can end. This technique enables the track to make the can end stiff enabling the cutting edges of the flanges to cut into the can more easily and prevent merely a dent rather than a cut being formed in the can end.

Figure 7:
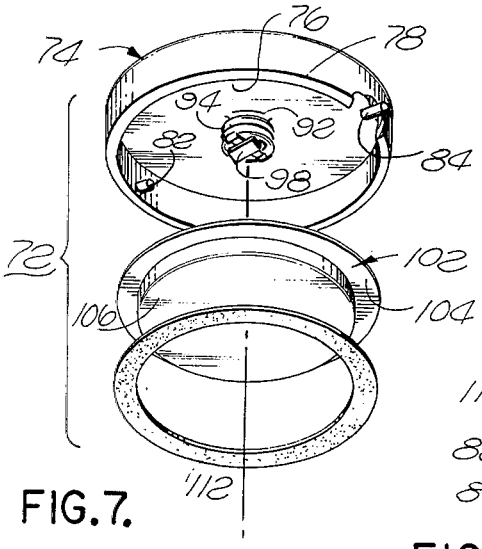
FIG. 7 is an exploded perspective view of the removable cap used to cover the valve cover cavity when the oil can opener is not in use.

Referring now to FIG. 7 a cap 72 is used to close the cavity opening 32 when the can opening mechanism 36 is not in use. The cap 72 comprises a cup shaped cover member 74 having a top end wall 76 and a tip 78 which depends at right angles around the periphery of the end wall. A pair of bayonet locating pins 82 and 84 are spaced 180 degrees apart on the lip 78 and extend transversely therethrough.

Figure 9:
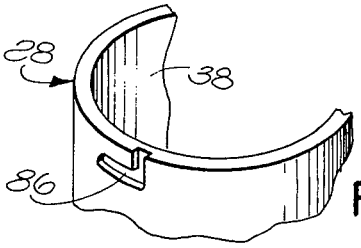
FIG. 9 is a view of a portion of the valve cover illustrating the mounting structure for mating with the cap of FIG. 7.
Figure 8:
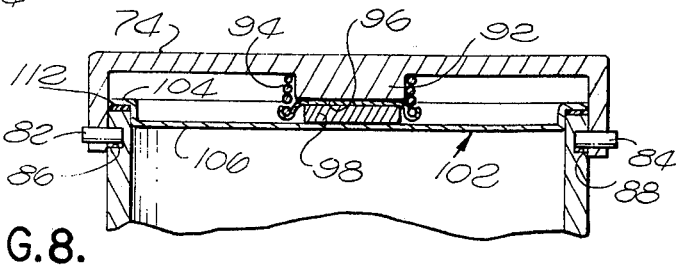
FIG. 8 is a cross-sectional view illustrating the method of sealing the can opener of FIG. 7 to the valve cover.

As shown in FIGS. 8 and 9, the pins 82 and 84 extend into cam and lead in slots 86 and 88 respectively formed on the outer surface of the cavity 28 enabling the cap 72 to be secured to the cavity. By extending the locating pins through the exterior surface of the lip 78, the interior portion of the pins can be located so as to be correctly positioned on the cavity 28. A cylindrical base 92 extends downwardly from the end wall 76 and forms a mounting surface for a spring 94 which surrounds the base 92. A free end 96 of the base 92 has a spring retainer 97 thereon and a magnet 98 is positioned adjacent the retainer.

The cap 72 further comprises a baffle 102 formed of an annular ring 104 having a cup shaped member 106 integrally formed with the interior edge of the annular ring so as to form a recess into which the magnet 98 in the cover will extend as illustrated in FIG. 8. An annular paper gasket 112 is positioned adjacent to the bottom surface of the annular ring 104 so that when the cap is secured to the cavity 32, a good seal is formed around the opening 28 of the cavity.

When the cap 74 is positioned on the cavity 28, the cover 74 is rotated along the cam and lead in slot. However, the magnet 98 enables the cover 74 to rotate with respect to the baffle 102. Thus, the cover can easily turn and the spring 94 provides a seal for the cap. By providing the cap as illustrated, wherein the cover rotates but the baffle does not, the cover is easily rotated with respect to the baffle. Additionally, the magnet 98 retains the baffle 102 and the cover 74 together as an assembly, when the cap 72 is removed from the cavity 28. Such an arrangement prevents sticking of the cap which typically occurs with a rubber gasket and screw thread cap.

Typically, spring pressure exerted by the spring 94 is in excess of any engine pressure developed in the crank case. While the gasket 112 can be typically made of paper as illustrated, a recess can be provided should it be desired to use an O-ring seal.

While the cavity 28 is illustrated as being positioned at one end of the valve cover 12, it should be understood that the cavity could be positioned along the length of the valve cover dependent upon the internal configuration of the engine and engine compartment accessories.

I claim:

1. A valve cover for an engine having a built in can opener comprising:

an elongated trough member defined by a top wall and a side wall, the free edges of said side wall being integrally connected to a mounting flange for securing the valve cover to an engine block;

a cylindrically-shaped cavity whose axis intersects the plane of said mounting flange said cavity walls extending from said valve cover mounting flanges to a top wall adjacent said valve cover top wall and having means for opening oil cans inserted therein, said cavity walls being integrally formed with said valve cover side wall and said mounting flange; and a removable cap positioned over said cavity adjacent said valve cover top wall.

2. A valve cover in accordance with claim 1 wherein said cavity wall defines one end of said valve cover side wall.

3. A valve cover in accordance with claim 1 wherein said cap includes a baffle which is secured to the interior of said cap by means of a magnet, spring means secured to said cap interior for exerting a down pressure on said baffle when said cap is secured to said valve cover, said magnet enabling said cap to rotate with respect to said baffle.

4. A valve cover in accordance with claim 3 wherein said outer surface of said cavity contains at least one groove, a pin extending transversely through lip of said cap wall, the interior portion of said pin mating with said groove when said cap is secured to said cavity, said exterior portion of said pin providing indication of said interior position of said pin when said pin is initially inserted in said groove.

5. A valve cover in accordance with claim 1 wherein said means for opening and draining said oil can include a tapered piercing member secured to the inner surface of said cavity by means of pin means, said pin means providing a stop during entry of said can into said cavity.

6. A valve cover in accordance with claim 5 wherein a track formed of an elongated metal strip is secured to said piercing member, said track causing the portion of said can lid opened by said piercing member to stiffen as the can is inserted in said cap.

7. A valve cover in accordance with claim 6 wherein said piercing member of said track extends lengthwise along the axis of said cavity, transverse portions of said piercing member initially contacting said can lid prior to a respective adjacent portion of said strip contacting said lid as said can is inserted in said cavity, further insertion of said can is said cavity enabling the portion of said strip to initially contact said lid prior to the time the respective transverse portion of said piercing member contacts said lid.

* * * * *